United States Patent [19]

Jacobsson

[11] 4,114,822

[45] Sep. 19, 1978

[54] THREAD DELIVERY DEVICE FOR TEXTILE MACHINES

[75] Inventor: Kurt Arne Gunnar Jacobsson, Ulricehamn, Sweden

[73] Assignee: Aktiebolaget IRO, Ulricehamn, Sweden

[21] Appl. No.: 825,765

[22] Filed: Aug. 18, 1977

[30] Foreign Application Priority Data

Aug. 18, 1976 [DE] Fed. Rep. of Germany ..... 2637120

[51] Int. Cl.[2] ..... B65H 51/20

[52] U.S. Cl. ..... 242/47.01

[58] Field of Search ..... 242/47.01, 47.04, 47.05, 242/47.06, 47.07, 47.08, 47.09, 47.1, 47.11, 47.12, 47.13, 49; 66/132 R

[56] References Cited

U.S. PATENT DOCUMENTS

| | | | |
|---|---|---|---|
| 3,776,480 | 12/1973 | Lawson | 242/47.01 |
| 3,928,987 | 12/1975 | Jacobsson | 242/47.01 X |
| 3,976,259 | 8/1976 | Newberry et al. | 242/47.01 X |
| 3,994,446 | 11/1976 | Jacobsson | 242/47.01 |
| 4,047,398 | 9/1977 | Fecker et al. | 242/47.01 X |

*Primary Examiner*—Stanley N. Gilreath
*Attorney, Agent, or Firm*—Blanchard, Flynn, Thiel, Boutell & Tanis

[57] ABSTRACT

A thread delivery device including a rotatable thread drum on which a thread is wound tangentially to form an intermediate thread storage and from which the thread is withdrawn endwise over a withdrawal edge for supply to a textile machine. A thread control element is arranged in the area of the withdrawal edge for engaging the withdrawn thread. A stationary withdrawal eyelet engages the withdrawn thread downstream of the thread control element. The thread control element is constructed as an eyelet which is closed at least opposite the direction of the rotation of the off-running thread relative to the drum. This thread control element is arranged approximately at the height of the withdrawal edge and is mounted on an arm which is rotatably supported on the drum about the longitudinal axis thereof. The friction in the rotatable bearing between the arm and the drum is of a magnitude such that the arm rotates with the drum only when the tension in the withdrawn thread falls below a desired magnitude. So long as the tension equals said desired magnitude, this tension is sufficient to overcome the friction so that the drum rotates relative to the arm, and the arm is held against a stop which limits the rotative movement of the thread control element in a direction opposite to the normal drum rotation.

10 Claims, 2 Drawing Figures

THREAD DELIVERY DEVICE FOR TEXTILE MACHINES

FIELD OF THE INVENTION

The invention relates to a thread delivery device for textile machines, comprising a thread drum which can be driven for rotation, on which the thread which comes from a storage bobbin can be wound tangentially for forming an intermediate storage and from which the thread can be withdrawn endwise over a withdrawal edge of the drum, and then over a thread control element which is arranged in the area of the withdrawal edge and through a stationarily arranged withdrawal eyelet.

BACKGROUND OF THE INVENTION

A known thread delivery device of this type (OS No. 2 312 267) has a thread control element which is constructed as an open hook, which thread control element is supported movably in two positions outside of the thread drum on a stationary support arm and is provided slightly below the withdrawal edge. The movement of the hook from a first position for positive thread delivery into a second position, in which it does not come into contact with a running off thread, is done manually. In the case of a positive thread delivery the hook mouth which is open in the direction of rotation of the drum catches the running off thread, which prior to leaving the drum runs through between the elastic fingers of a brake ring and the withdrawal edge and thus receives an even withdrawal tension. This known thread delivery device operates functionally satisfactorily. However, the open hook has a disadvantage for certain mixed yarns in that a downwardly directed power component acts onto the off-coming thread, so that in the case of mixed yarns, which because of their loose fibers or for other reasons tend to have a strong adhesion between adjacent windings, there exists the danger that the respectively next following winding is also moved downwardly and withdrawn. This causes an overfeeding of yarn.

The purpose of the present invention is to produce a thread delivery device of the above-mentioned type, preferably for positive thread delivery, which permits with simple means for any type of yarns a secure and uniform thread delivery with an even tension.

The purpose is attained inventively by the thread control element constructed as an eyelet, which is closed or can be closed at least opposite the direction of rotation of the off-running thread and is arranged approximately at the height of the withdrawal edge of the drum. This eyelet is mounted on an arm which is relatively rotatably supported on the drum shaft below the drum floor, said arm being rotatably frictionally supported on the drum shaft such that it is moved along by the shaft only when the actual thread tension falls below a desired thread tension so that the friction between the shaft and arm permits the latter to be rotated with the drum. A stop limits the movement of the thread control element opposite the direction of rotation of the drum.

In the inventive device the braking of the movably supported arm assures a constant position at a positive thread delivery, namely at a constant withdrawing speed. In the case of overfeeding or thread breakage, which causes a strong decrease in the thread withdrawal tension, the arm can move along in the direction of rotation of the drum. At the same time the changed position of the arm indicates the breakdown. A further important advantage of the device consists in the stopped thread control element applying a frictional braking action on the off-running thread, so that the brake ring with the elastic fingers is not needed in this embodiment. In the case of a thread withdrawal tension which increases too much, the top prevents moving of the eyelet against the direction of rotation of the drum.

The stop can be advantageously movably mounted relative to the path of the thread control element. The thread delivery device can thus in a simple manner be changed over to an intermittent delivery.

In a preferred embodiment a pawl is provided as a stop, which pawl has an abutting surface at its one end zone, which abutting surface can be overtraveled in the direction of rotation of the drum and has a blocking surface which faces in the direction of rotation of the drum. The blocking surface thereby prevents movement opposite the direction of drum rotation, whereas the thread control element arrives at the abutting surface if in the case of a sudden thread tension drop the eyelet is hauled along with the drum for almost one entire drum revolution.

The pawl can be supported pivotally on a swivel axis which is arranged spaced from its two end zones and can be held in a rest position against a support member by means of a spring which is supported on its end zone which is opposite the abutting surface such that it carries out a swiveling lifting off from the support member upon overtraveling of the abutting surface by the thread control element. The arm which is moved along during a thread tension drop thus moves the pawl automatically from its path and can thus, if necessary, move along with further drum rotations, without which it would be stopped and overstressed.

A further function can be advantageously transferred to the thread control element such that the pawl has associated with it a disconnecting switch which can be operated by the pawl swiveling motion during overtraveling of the abutting surface. Thus switching off after a strong drop in tension is caused on the path through the pawl by the thread control element.

BRIEF DESCRIPTION OF THE DRAWINGS

One exemplary embodiment of the invention is illustrated and described hereinafter in connection with the drawing, in which.

DETAILED DESCRIPTION

Figure 1:
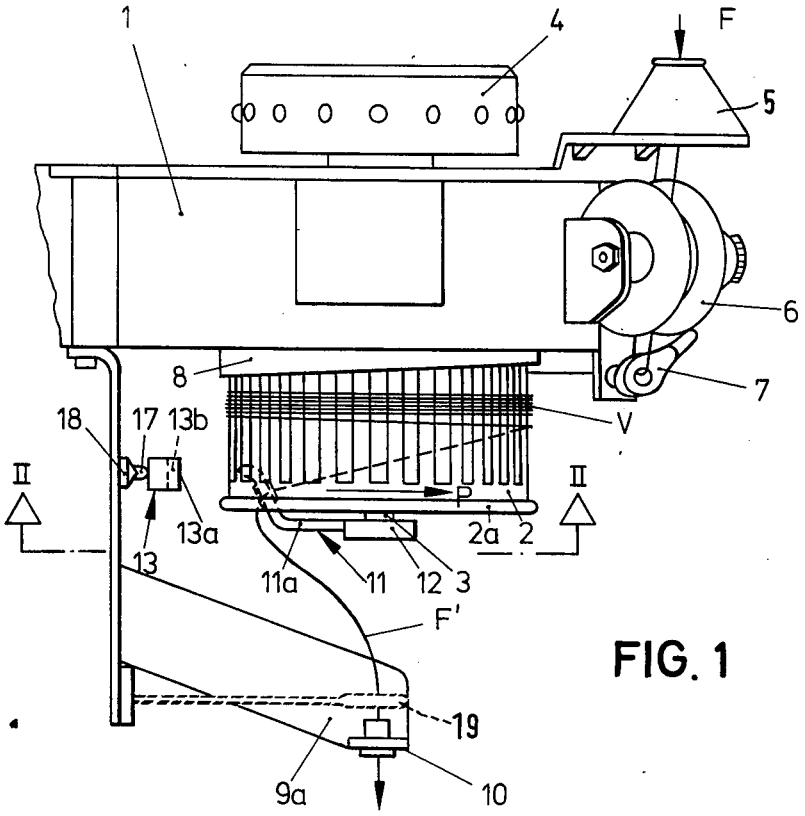
FIG. 1 is a schematized side view of an inventive thread delivery device for a positive thread delivery.

The device has a housing 1 which can be secured on the textile machine by means which are not shown. A thread drum 2 is supported rotatably on the housing 1 by means of a shaft 3. The shaft 3 is driven through a pin wheel 4 by means of a perforated belt (not shown). The thread F comes from a storage bobbin (not shown), it runs through a thread guide 5, a disk brake 6 and a shut-off eye 7, in order to be then wound up tangentially onto the thread drum 2 which rotates in the direction of the arrow P. The thread drum 2 has associated with it a sloped feed disk 8, which moves thread windings which are forming in the axial direction of the drum, so that an intermediate thread storage V is formed on the drum. The thread is withdrawn from the intermediate storage V over a lower withdrawing edge 2a of the thread drum 2.

A support arm 9, which is secured at one end on the housing 1 and extends substantially parallel to the drum axis, has a withdrawing eyelet 10 on its bent free end 9a, through which the offrunning thread F' is guided to the textile machine. The eyelet 10 is substantially aligned with the rotational axis of the drum.

A thread control element 11 with a bent arm 11a and a closed eyelet 11b which is arranged spaced from its radially inner end is supported rotatably on the shaft 3 by means of a roller bearing 12, namely on the shaft end which projects downwardly from the lower end wall of the thread drum. The bend in the arm 11a and the arrangement of the eyelet 11b on same is dimensioned such that the eyelet 11b is positioned approximately at the level of the withdrawing edge 2a of the thread drum. The end zone 11c of the arm 11a, which end zone extends beyond the eyelet 11b, forms a nose which cooperates with a stop which is identified as a whole with reference numeral 13. The stop 13 is constructed as a pawl 13 and can be swung about a bearing 14, which is secured on the support arm 9 with a mounting which is only schematically indicated. An end zone of the pawl 13 enlarges from the end in a direction toward the bearing, formed an abutting surface 13a which faces the drum 2, and ends in a blocking surface 13b which extends approximately perpendicularly with respect to the main direction of extent of the pawl. The opposite end of the pawl 13 is connected to a tension spring 16, the other end of which is secured on the support arm 9, and which brings the pawl to abut a support member 17 which is arranged also on the support arm 9. Furthermore, a disconnecting switch 18 is mounted on the support arm 9 such that it lies approximately opposite the enlarged end of the pawl 13.

OPERATION

Figure 2:
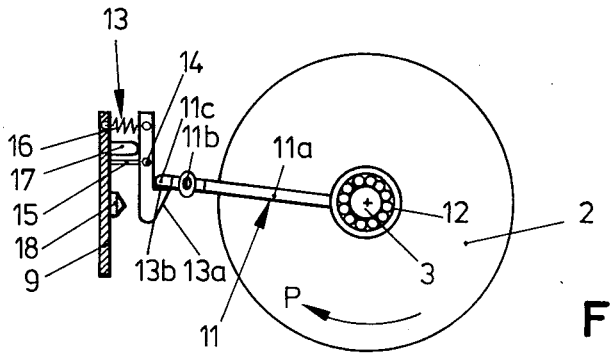
FIG. 2 illustrates a part of the device, viewed from below, along the line II—II of FIG. 1.

The thread control element 11 cooperates as follows with the stop 13: The off-coming thread F' runs through the eyelet 11b between the withdrawal edge 2a of the drum and the withdrawal eyelet 10. The friction of the roller bearing 12 on the shaft 3 is tuned to the desired withdrawal tension of the thread such that the thread F' is slightly frictionally braked when running through the eyelet 11b and, as long as the withdrawal tension remains substantially constant, the withdrawal tension overcomes the friction in bearing 12 so that the arm 11a remains stationary relative to the housing and is held by the withdrawal thread against the blocking surface 13c. FIG. 2 shows how the nose 11c of the thread control element rests on the blocking surface 13b of the stop 13 during a normal positive thread supply operation. Further movement in this direction is prevented by the stop 13 so that positive thread delivery is assured. At a slight drop in the thread withdrawal tension which may occur during the normal operation, the arm 11a can move from the position according to FIG. 2 in a clockwise direction, for example into the position according to FIG. 1.

When the withdrawal tension which acts on the thread F' drops off, be it due to a thread breakage or an overfeeding, the friction between the shaft 3 and the roller bearing 12 is sufficient to rotatably drive the thread control element 11 along the drum in the direction of drum rotation. After approximately one revolution the nose 11c of the thread control element reaches the enlarged end zone of the pawl 13 and runs onto the abutting surface 13a. Through this the thread control element automatically pivots the pawl 13 about the pivot bearing 14 against the force of the tension spring 16 so that the pawl operates the disconnecting switch 18. With this the textile machine and the drum drive is stopped. The thread control element thus serves not only as a withdrawing eyelet and thread brake but also as a shut-off device.

The invention is not limited to the exemplary embodiments. Thus it is possible to provide instead of a closed eyelet, which is preferred, a thread control element formed as a partially open eyelet, as long as same is closed in a direction opposite the direction of rotation of the off-running thread. Also the arm may have a different configuration and the stop 13 for cooperation with a thread control element of a different form may be constructed suitably differently and may be supported differently. In place of the disconnecting switch 18 it is also possible to use a swingable cut-off eyelet 19 which is illustrated by dashed lines in FIG. 1, as it is described for example in German Pat. No. 2 341 398.

The embodiments of the invention in which an exclusive property or privilege is claimed as defined as follows:

1. In a thread delivery device for textile machines, including a thread drum which can be driven for rotation about its longitudinal axis and on which a thread which is supplied from a storage bobbin can be wound tangentially for forming an intermediate thread storage and from which the thread can be withdrawn endwise over a withdrawal edge of the drum, a thread control element arranged in the area of the withdrawal edge for engaging the withdrawn thread, and a stationarily arranged withdrawal guide for engaging the withdrawn thread after it passes over the thread control element, comprising the improvement wherein the thread control element is constructed as an eyelet which is closed at least opposite the direction of rotation of the offrunning thread relative to the drum and is arranged approximately at the height of the withdrawal edge of the durm, the eyelet being mounted on an arm, bearing means coacting between the arm and the drum for rotatably supporting the arm on the drum for relative rotation therebetween about said longitudinal axis, said arm being stopped relative to the drum due to friction in said bearing means such that the arm is rotated along with the drum only when the actual tension in the withdrawn thread falls below a desired thread tension, the actual tension in the withdrawn thread when equal to said desired thread tension overcoming the friction in said bearing means so that said drum rotates relative to said arm, and a stop for limiting the rotative movement of the thread control element opposite the direction of rotation of the drum.

2. A device according to claim 1, wherein the stop is movably mounted so as to be movable out of the path of the thread control element.

3. A device according to claim 2, wherein the stop comprises a pawl with an abutting surface which engages the thread control element and permits it to pass thereover in the direction of rotation of the drum, and the pawl also having a blocking surface which faces in the direction of drum rotation and is positioned for engagement with the thread control element.

4. A device according to claim 3, wherein the pawl is supported swingably on a pivot bearing which is arranged spaced from its two end zones and is held against a support member in a rest position by means of a tension spring which is supported on its end zone which is opposite the abutting surface such that it carries out a swing lifting off from the support member during engagement and movement along the abutting surface by the thread control element.

5. A device according to claim 4, wherein the pawl has associated with it a disconnecting switch which can be operated by the swinging motion of the pawl during engagement and movement along the abutting surface by the thread control element.

6. A device according to claim 4, wherein the arm has a projecting nose which is bent beyond the eyelet and is disposed for engagement with the pawl.

7. A device according to claim 1, wherein said stop is normally maintained in a first position wherein it is disposed within the path of the thread control element, said stop being engaged with the thread control element when the withdrawn thread is at said desired thread tension for preventing rotative movement of the thread control element opposite the direction of rotation of the drum, said stop being movably mounted so as to be movable into a second position disposed out of the path of the thread control element.

8. A device according to claim 7, including spring means coacting with said stop for normally urging same into said first position, and cam means associated with said stop and engagable with said thread control element when the latter is rotating in the same direction of rotation as the drum for causing the stop to be moved into said second position in opposition to the urging of said spring means.

9. A device according to claim 8, including switch means positioned for actuation by the stop when the latter is moved into said second position for causing deactivation of the thread delivery device.

10. A device according to claim 7, including switch means positioned for actuation by the stop when the latter is moved into said second position for causing deactivation of the thread delivery device.

* * * * *